United States Patent [19]

Narita et al.

[11] Patent Number: 4,535,503

[45] Date of Patent: Aug. 20, 1985

[54] DOOR GLASS HINGE HAVING A SPACER RING

[75] Inventors: Ryuhei Narita, Yokohama; Hiroyuki Aida, Hatano; Yoshinori Kamiya, Zama, all of Japan

[73] Assignee: Nissan Motor Company, Limited, Yokohama, Japan

[21] Appl. No.: 621,887

[22] Filed: Jun. 19, 1984

Related U.S. Application Data

[63] Continuation of Ser. No. 386,647, Jun. 9, 1982, abandoned.

[30] Foreign Application Priority Data

Aug. 17, 1981 [JP] Japan ..... 56-128325

[51] Int. Cl.[3] ..... E05D 5/02

[52] U.S. Cl. ..... 16/382; 16/109; 296/56; 296/76

[58] Field of Search ..... 16/108, 109, , 223, 16/238, 245, 246, 247, 372, 382, 387, DIG. 4; 296/56, 76

[56] References Cited

U.S. PATENT DOCUMENTS

| | | | |
|---|---|---|---|
| 1,497,217 | 6/1924 | Hodny | 16/DIG. 4 X |
| 2,674,487 | 4/1954 | Wernig | 296/76 |
| 2,936,050 | 5/1960 | McLaughlin | 189/36 |
| 4,343,504 | 8/1982 | Tomioka et al. | 296/76 |

FOREIGN PATENT DOCUMENTS

| | | | |
|---|---|---|---|
| 246719 | 1/1963 | Australia . | |
| 263517 | 8/1963 | Australia . | |
| 500650 | 3/1954 | Canada | 16/382 |
| 2063015 | 7/1972 | Fed. Rep. of Germany | 16/382 |
| 2653559 | 6/1978 | Fed. Rep. of Germany | 16/382 |
| 2748623 | 5/1979 | Fed. Rep. of Germany | 16/382 |
| 1262645 | 4/1961 | France . | |
| 1491438 | 7/1967 | France . | |
| 2215827 | 8/1974 | France . | |
| 1207957 | 10/1970 | United Kingdom . | |

*Primary Examiner*—Fred A. Silverberg

*Attorney, Agent, or Firm*—Lane, Aitken and Kananen

[57] ABSTRACT

A hinge includes first and second members, a backing member, and a connecting member. The connecting member connects the backing member to the second member in such a manner as to be able to vary the distance between the second and backing members. A brittle object is located between the second and backing members. First and second packings are provided between the brittle object and the second member, and between the brittle object and the backing member, respectively. A spacer is provided between the second and backing members. The dimension of the spacer along the distance between the second and backing members is chosen so that when the connecting member is adjusted until the spacer comes into contact with both the second and backing members, the second and backing members clamp therebetween the brittle object by way of the packings with an optimal clamping force exerted on the brittle object.

1 Claim, 4 Drawing Figures

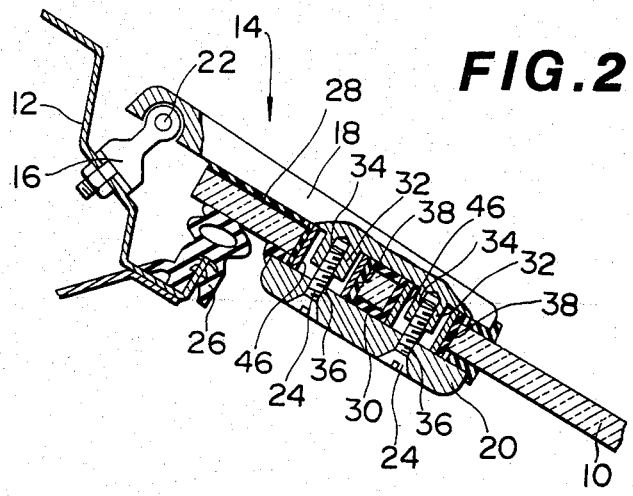
FIG.2
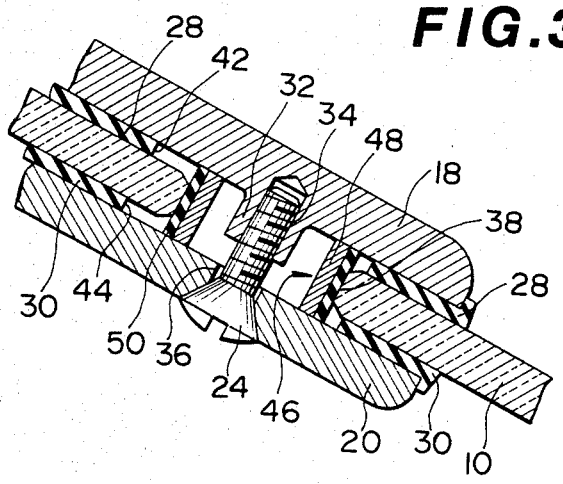
FIG.3
FIG.4
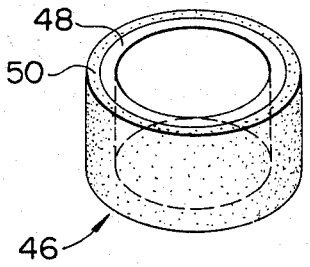

DOOR GLASS HINGE HAVING A SPACER RING

This application is a continuation of application Ser. No. 386,647, filed June 9, 1982, now abandoned.

BACKGROUND OF THE INVENTION

1. Field of the Invention

This invention relates to a hinge for pivotally connecting a brittle object and another object, and to, for example, that for hinging a glazed back-door to the body of a station wagon or coupe-type automotive vehicle.

2. Description of the Prior Art

Some of the automotive vehicles, such as station wagons or coupes, have back doors made of window glazing, which are pivotally mounted on the vehicle bodies by hinges. One type of these hinges has a movable member and a backing member, which clamp therebetween part of the glass of the door with packing interposed between the glass and both the backing and movable members to protect the door glazing. The distance between the members can be changed by screws to adjust the clamping force on the glass. However, it is usually difficult to easily adjust the clamping force to an optimal level which ensures reliable clamping of the glass of the door without damaging it.

SUMMARY OF THE INVENTION

It is an object of this invention to provide a hinge for a brittle object, such as a glass, which can easily set the clamping force on the object to an optimal level.

In accordance with this invention, a hinge for a brittle object, such as a glass, includes pivotally connected first and second members, a backing member, and a connecting member. The connecting member adjustably connects the backing member to the second member in such a manner that the distance between the second and backing members varies as the connecting member is adjusted. Part of the brittle object is located between the second and backing members. The hinge also includes deformable first and second packings provided between the brittle object and the second member, and between the brittle object and the backing member, respectively. The hinge further includes a spacer provided between the second and backing members. The dimension of the spacer, parallel to the distance between the second and backing members, is greater than that of the brittle object but smaller than the sum of that of the brittle object and those of the respective packings in the original conditions. This dimensional feature ensures that when the connecting member is adjusted until the spacer comes into contact with both the second and backing members, the second and backing members clamp therebetween the brittle object by way of the packings with a predetermined clamping force exerted on the brittle object.

The above and other objects, features and advantages of the present invention will be apparent from the following description of a preferred embodiment thereof, taken in conjunction with the drawings.

BRIEF DESCRIPTION OF THE DRAWINGS

FIG. 2 is a cross-sectional view of the hinge of FIG. 1 taken along line II—II of FIG. 1;

FIG. 3 is an enlarged view of an essential portion of the hinge in FIG. 2; and

FIG. 4 is a perspective view of the spacer of FIGS. 2 and 3.

DESCRIPTION OF THE PREFERRED EMBODIMENT

Figure 1:
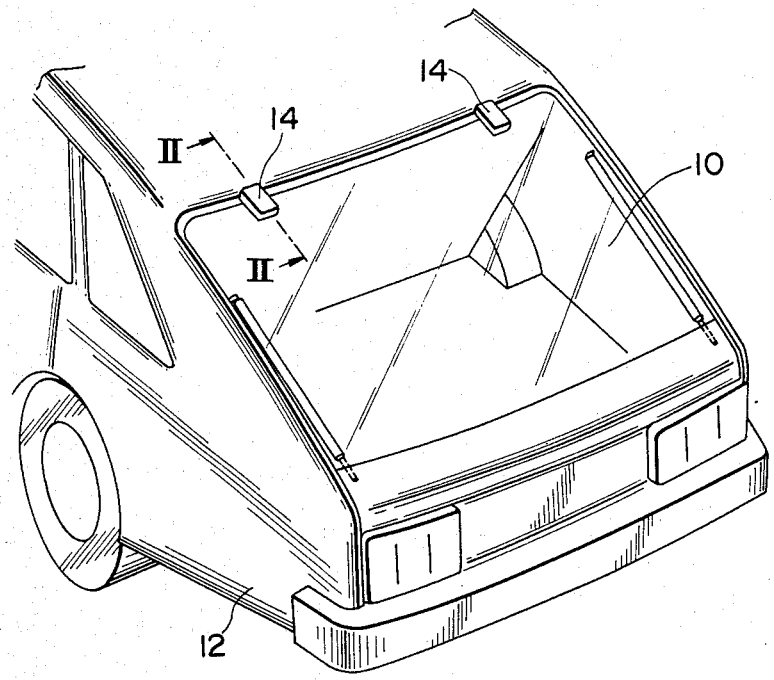
FIG. 1 is a perspective view of the rear of an automotive vehicle having a glazed back-door which is pivoted to the vehicle body by means of hinges of this invention.

With reference to FIG. 1, there is shown the rear of an automotive vehicle, which has a glazed back-door 10 pivotally mounted on the rear edge of the roof panel of a vehicle body 12 by means of a pair of hinges 14 of this invention. The two hinges 14 are identical.

As shown in FIG. 2, the hinge 14 has a stationary first member 16, a movable second member 18, and a backing member 20. One edge of the movable member 18 is pivoted at 22 to one end of the stationary member 16. The other end of the stationary member 16 is bolted to the vehicle body roof panel 12. The movable member 18 is thus free to rotate about the pivot 22. The movable and backing members 18 and 20 essentially consist of substantially flat plates. The backing plate 20 is connected in parallel with the movable plate 18 by means of a plurality of screws 24.

The back door 10 essentially consists of a sheet of window glazing or glass, and is clamped securely between the movable and backing plates 18 and 20 in a parallel manner to be hinged virtually to the roof panel 12. Thus, the door glass 10 is free to pivot in conjunction with the movable plate 18 of the hinge 14. The rearward edges of the movable and backing plates 18 and 20 are aligned. The backing plate 20 is shorter in total longitudinal length than the movable plate 18, so that the plate 18 extends frontward beyond the plate 20. The plates 18 and 20 are outside and inside the vehicle respectively. Similarly, the door glass 10 extends frontward beyond the plate 20 but not as far as plate 18. A weatherstrip 26 is provided between the rear edge of the roof panel 12 and the front edge of the door glass 10 to prevent ingress of rain water into the interior of the vehicle without hampering movement of the door 10.

As shown in FIGS. 2 and 3, sheets of deformable or resilient packings, for example, gaskets 28 and 30 are provided between the door glass 10 and the plate 18, and between the door glass 10 and the plate 20, respectively, to prevent ingress of rain water into the interior of the vehicle and to protect the door glass 10. The movable plate 18 has a plurality of bosses 32 of circular cross-section, which protrude perpendicularly from the rest of the plate 18 toward the plate 20. The movable plate 18 also has a plurality of threaded holes 34, which are coaxial with the bosses 32 respectively and open at the distal ends of the bosses 32 respectively. The backing plate 20 has therethrough a plurality of non-threaded holes 36 aligned with the respective holes 34. The door glass 10 has therethrough a plurality of holes 38 of circular cross-section aligned with the respective holes 34 and 36. The packings 28 and 30 respectively have therethrough a plurality of circular openings 42 and 44 substantially aligned with the respective holes 38 and of inside diameter greater than the holes 38. The holes 38 through the door glass 10 have an inside diameter considerably greater than the outside diameter of the respective bosses 32 so as to accommodate therein the respective bosses 32.

The screws 24 coaxially extend through or in the respective holes 34, 36, 38, 42, and 44 in such a manner that the distal ends of the screws 24 anchor in the respective holes 34 and the heads thereof seat in the respective holes 36. The screws 24 engage the movable plate 18 by means of the threads. The holes 36 are recessed at the ends remote from the plate 18 so as to accommodate the heads of the screws 24, so that the screws 24 can rotatably engage the backing plate 20. As the screws 24 are turned, the gap or the distance between the movable and backing plates 18 and 20 is varied.

A plurality of ring spacers 46 are provided between the plates 18 and 20, and extend coaxially through the respective holes 38 and openings 42 and 44. The spacers 46 have an outside diameter substantially equal to the inside diameter of the holes 38, and therefore snugly fit within the respective holes 38. The spacers 46 accommodate the respective screws 24 and the bosses 32. The inside diameters of the spacers 46 are considerably greater than the outside diameters of the screws 24 and the bosses 32, so that the spacers 46 do not contact the screws 24 or the bosses 32. As best shown in FIGS. 3 and 4, each of the spacers 46 consists of a hollow cylindrical core 48 and a layer 50 fixed concentrically onto the periphery of the core 48. The core 48 is made of a rigid material, such as metal or synthetic resin. The layer 50 is made of deformable or resilient material, such as rubber fixed to the core 48 by normal adhesion or heat-utilizing adhesion. The layer 50 prevents direct contact between the door glass 10 and the core 48 so as to protect the door glass 10.

Each of the spacers 46 has an axial length greater than the thickness of the door glass 10 but smaller than the sum of the thickness of the door glass 10 and the original or relaxed thicknesses of the packings 28 and 30 so as to define the minimum gap or distance between the plates 18 and 20. The axial length of each spacer 46 is chosen so that when the screws 24 are tightened until the plates 18 and 20 come into contact with the spacers 46, the plates 18 and 20 will clamp therebetween the door glass 10 by way of the packings 28 and 30 with an optimal magnitude of force exerted on the door glass 10. The optimal magnitude of clamping force is defined as that which ensures the most reliable clamping of the glass plate 10 without damaging it. Thus, it is easy to precisely set the clamping force on the door glass 10 to an optimal level, since the optimal level is obtained by tightening the screws 24 until the plates 18 and 20 come into contact with the spacers 46 and thus the screws 24 cannot be tightened further. The spacers 46 prevent excessive force from being exerted on the door glass 10. It should be noted that each boss 32 has an axial length smaller than that of the respective spacers 46 so as to not come into contact with the backing plate 20.

The considerable difference between the inside diameter of the spacers 46 and the outside diameter of the bosses 32 compensates for tolerance variations between the door glass 10 and the hinges 14, and thus those between the door glass 10 and the vehicle body, thereby facilitating assembly and positional adjustments thereof.

It should be understood that further modifications and variations may be made in the present invention without departing from the spirit and scope of the present invention as set forth in the appended claims.

What is claimed is:

1. An apparatus for hinging a back door of an automotive vehicle wherein the back door includes a door glass with a hinge having a movable member and a backing member which together clamp a portion of the door glass therebetween with deformable packings respectively interposed between the glass and both the backing member and the movable member, a stationary hinge member to which the movable hinge member is pivotally connected, the stationary hinge member being fixed to the vehicle body, the improvement comprising in combination means for adjusting the clamping force on the glass to a predetermined magnitude, the clamping force adjustment means comprising:

a first opening defined by said movable member in alignment with a second opening defined by said backing member receiving a fastening member therein to secure said movable member to said backing member;

a third opening in said movable member and located about said first opening, said third opening being larger in diameter than said first opening;

a fourth opening in said door glass aligned with said first and second opening;

fifth and sixth openings defined respectively by said packings, each having a diameter greater than said fourth opening defined by said door glass; said first through sixth openings together defining a cavity in the combination of said movable member, backing member, and fastening member;

a separate ring spacer located in said cavity and extending coaxially through said fourth, fifth, and sixth openings, said ring spacer including a rigid member and a resilient member fixed to the periphery of said rigid member radially outwardly adjacent said door glass, said resilient member contacting the door glass, and said ring spacer having an outside diameter substantially equal to the inside diameter of said fourth opening and structurally adapted to accommodate the passage of said fastening member therethrough, said ring spacer having an axial length greater than the thickness of said door glass but less than the sum of the thickness of the door glass and the thickness of said packings when relaxed thereby to define a minimum distance between said movable member and said backing member, said axial length being further characterized so that when the fastening member is tightened, the fixed member and the movable member clamp said door glass therebetween with a force determined and limited by a tightening of the fastening member until said movable member and said fixed member contact said spacer, whereby excessive force is not exerted on said door glass wherein the spacer is spaced from the screw by a gap, and the movable hinge member is formed with a boss disposed within the spacer and having a hole receiving the screw, the boss being spaced from the spacer by a gap.

* * * * *